US007294256B2

(12) United States Patent
Happel et al.

(10) Patent No.: US 7,294,256 B2
(45) Date of Patent: Nov. 13, 2007

(54) STORM WATER FILTER SYSTEM

(76) Inventors: Henry Happel, 140 Ruby St., Rockledge, FL (US) 32955; Thomas H. Happel, 5041 Scott Rd., Cocoa, FL (US) 32926

( * ) Notice: Subject to any disclaimer, the term of this patent is extended or adjusted under 35 U.S.C. 154(b) by 42 days.

(21) Appl. No.: 11/317,788

(22) Filed: Dec. 27, 2005

(65) Prior Publication Data

US 2006/0163130 A1 Jul. 27, 2006

Related U.S. Application Data

(60) Provisional application No. 60/645,960, filed on Jan. 24, 2005.

(51) Int. Cl.
*E03F 5/14* (2006.01)

(52) U.S. Cl. ..... 210/155; 210/162; 210/170.03; 210/305; 210/532.1; 210/521

(58) Field of Classification Search ..... 210/155, 210/162, 163, 299, 305, 307, 521, 532.1, 210/170.03
See application file for complete search history.

(56) References Cited

U.S. PATENT DOCUMENTS 1,349,734 A * 8/1920 Riley ..... 210/155
5,405,539 A * 4/1995 Schneider ..... 210/170.03
5,779,888 A * 7/1998 Bennett ..... 210/162
5,980,740 A * 11/1999 Harms et al. ..... 210/162
6,217,757 B1 * 4/2001 Fleischmann ..... 210/299
6,270,663 B1 8/2001 Happel
6,379,541 B1 * 4/2002 Nicholas ..... 210/155
6,428,692 B2 8/2002 Happel
6,797,162 B2 9/2004 Happel
6,869,525 B1 3/2005 Happel
7,083,721 B2 * 8/2006 McClure et al. ..... 210/305
7,153,417 B2 * 12/2006 Happel ..... 210/154
2003/0034286 A1 * 2/2003 Butler ..... 210/163
2003/0121846 A1 * 7/2003 Use et al. ..... 210/521
2005/0051499 A1 * 3/2005 Nino ..... 210/163
2005/0183997 A1 * 8/2005 Happel et al. ..... 210/163

* cited by examiner

*Primary Examiner*—Christopher Upton
(74) *Attorney, Agent, or Firm*—William M. Hobby, III

(57) ABSTRACT

A storm water filter system for filtering storm water being fed into an in-ground well includes a housing having an inlet and an outlet, with the outlet being connected to an in-ground recharge well. A plurality of open chambers are formed in the housing. An inlet filter box has an open end located in the housing and positioned with the open end facing the housing inlet. An outlet screen filter is positioned over the outlet for capturing debris from water entering the outlet and has a bypass for water to pass when the filter becomes partially blocked.

7 Claims, 3 Drawing Sheets

STORM WATER FILTER SYSTEM

This application claims the benefit of U.S. Provisional Application No. 60/645,960 filed Jan. 24, 2005.

BACKGROUND OF THE INVENTION

The present invention is a storm water filter system which includes a filter and baffle box for filtering drain water before directing the water into a recharge well. The filter is installed within a storm water drain system and directs storm water runoff through a screen filter separator prior to the storm water drain water passing through a filter and into the recharge well.

Drain water, which is frequently laden with trash, grass clippings, tree limbs, sand, gravel, and other forms of sediment, is collected from streets, parking lots and other areas into a storm drain inlet where it is directed into a storm water drain pipe system. The drain water laden with trash and grass clippings, sand and gravel collected from the streets is fed through an entrance into a storm water catch basin and into a lake or retention pond. The retention pond can tolerate a certain amount of grass clippings collected from parking lots or along the street but debris left in water for a long period of time decays and allows a buildup of soluable nutrients, such as nitrate and phosphate to accumulate in the water. Thus, it is desirable to remove organic debris from the water collected from the drain water before it enters into lakes and retention ponds.

The present filter is added directly to the storm water drain pipe system for collecting trash, grass clippings, tree limbs, and organic matter in a manner to dry these materials before they can rot in the water and release soluable nutrients into the water. Sand, gravel, or other non-organic sediments are also collected within a drain water catch basin. The present system provides for an easily cleaned filter which allows rapid cleaning of the filter and filter box while filtering the water before it enters the recharge well.

In my prior U.S. Pat. No. 6,428,692 for an In-Line Storm Water Drain Filter System an in-line storm water drain filter and baffle box is installed within a storm water drain pipe to direct storm water runoff through the storm water drain pipe and through the filter and baffle box prior to the storm water drain water passing through an outfall into a lake, pond or retention area. This patent is for a filter system and includes a housing having an inlet and outlet and a plurality of chambers formed therein. The housing cover allows for access into a housing. A plurality of filter screens are mounted over each of the plurality of housing chambers for collecting trash from the storm water passing therethrough.

In my prior U.S. Pat. No. 6,270,663, a Storm Drain Filter System is placed beneath the grate of the entrance to a storm water catch basin and collects the entering storm water and filters out hydrocarbons, such as automobile oil, sand and debris, such as grass clippings from the storm water to provide a much cleaner water to a storm drain pipe.

In my prior U.S. Pat. No. 6,797,162 for a Catch Basin Filter for Storm Water Runoff, has the storm water enters the catch basin. This catch basin filter is designed for current inlet catch basins having a ramp along the curb front to allow storm water into the catch basin and to also allow water to enter through a grate covering the catch basin.

In my prior U.S. Pat. No. 6,869,525, a Storm Drain Filter System is placed beneath the grate of the entrance to a storm water catch basin to collect the entering storm water and filter out hydrocarbons, such as automobile sand and debris from the storm water to provide cleaner water to a storm drain pipe.

The present invention is an improvement over this prior U.S. patent and allows a screen filter system or basket to receive the inflow of storm water and to collect all of the larger debris while letting the water pass through the screen and into the baffle and settling box. The drain water in the baffle box then passes through a screen filter and into a discharge well. A plurality of doors in the filter basket allow for the easy cleaning of debris therefrom.

SUMMARY OF THE INVENTION

A storm water filter system for filtering storm water being fed into an in-ground well includes a housing having at least one side wall and a bottom and has an inlet and an outlet, with the outlet being connected to an in-ground well. A plurality of interior walls are located in the housing and attached to the housing bottom to form a plurality of open chambers therein. An inlet filter box has an open end located in the housing and positioned with the open end facing the housing inlet. An outlet screen filter is positioned over the outlet for capturing finer debris from water passing into the outlet. The outlet screen filter has a bypass for water to pass when the filter becomes partially blocked. The storm water filter system filters debris from the storm water being fed thereinto and a screen filter further blocks debris from entering into an in-ground well through the filter system outlet. The outlet screen filter extends generally vertical from the outlet and has an open top to allow water to bypass the filter screen when the filter screen is partially clogged. The filter system outlet extends through the housing bottom to about the height of the second interior wall and has the outlet screen filter extending thereabove. Each interior wall also has a turbulence deflector attached thereto to calm turbulence in the water in each open housing chamber. The inlet filter box has a bottom that can be opened to allow access to clean each open chamber formed in the bottom of the housing and is adjustably supported on a pair of metal posts within the housing and may set upon one of the interior walls.

BRIEF DESCRIPTION OF THE DRAWINGS

Other objects, features, and advantages of the present invention will be apparent from the written description and the drawings in which:

FIG. 1 is a cutaway perspective view of a storm drain filter system in which FIG. 1 is a cutaway perspective of the nutrient separating baffle box filter system of the present invention;

DESCRIPTION OF THE PREFERRED EMBODIMENT

Figure 1:
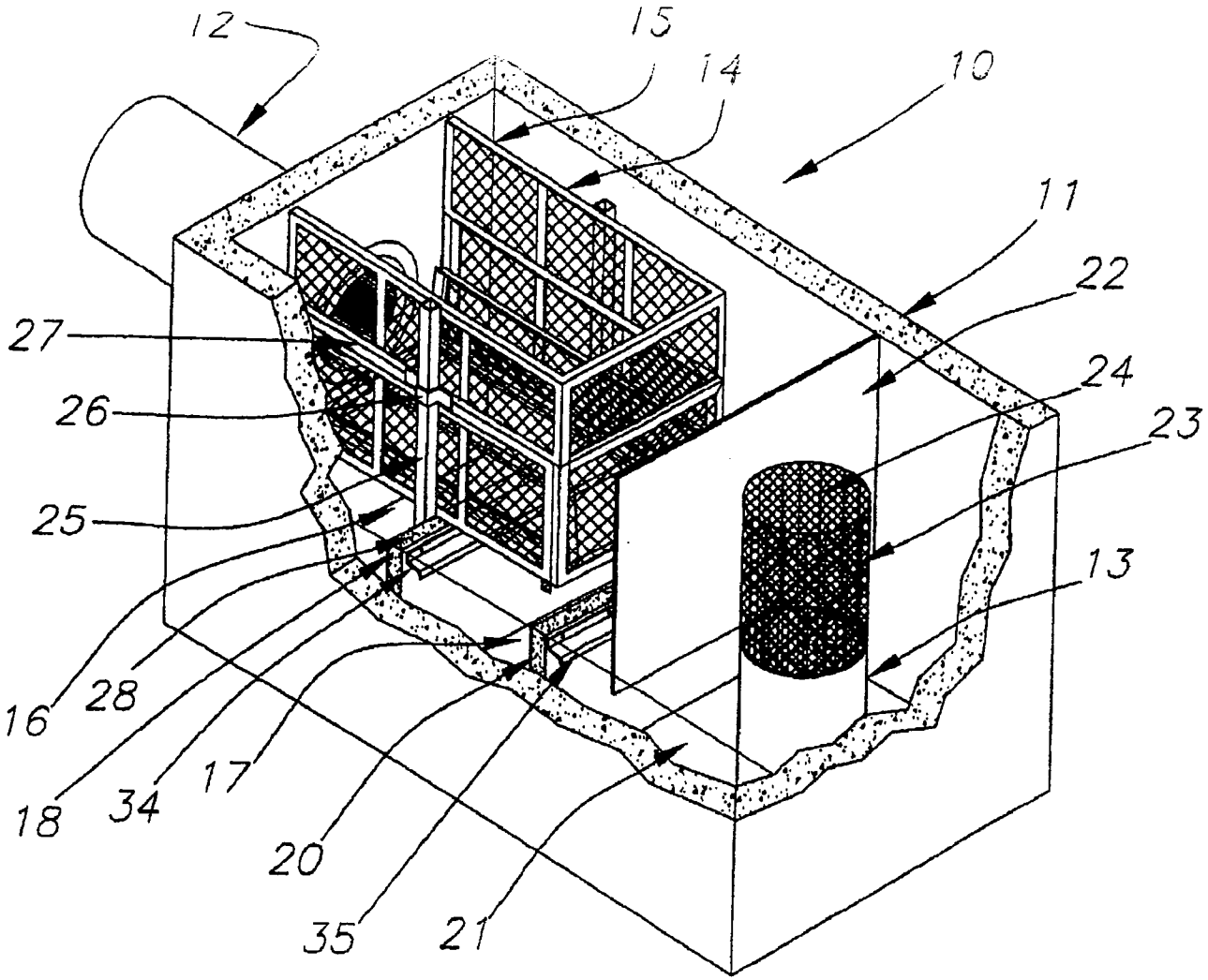
Figure 2:
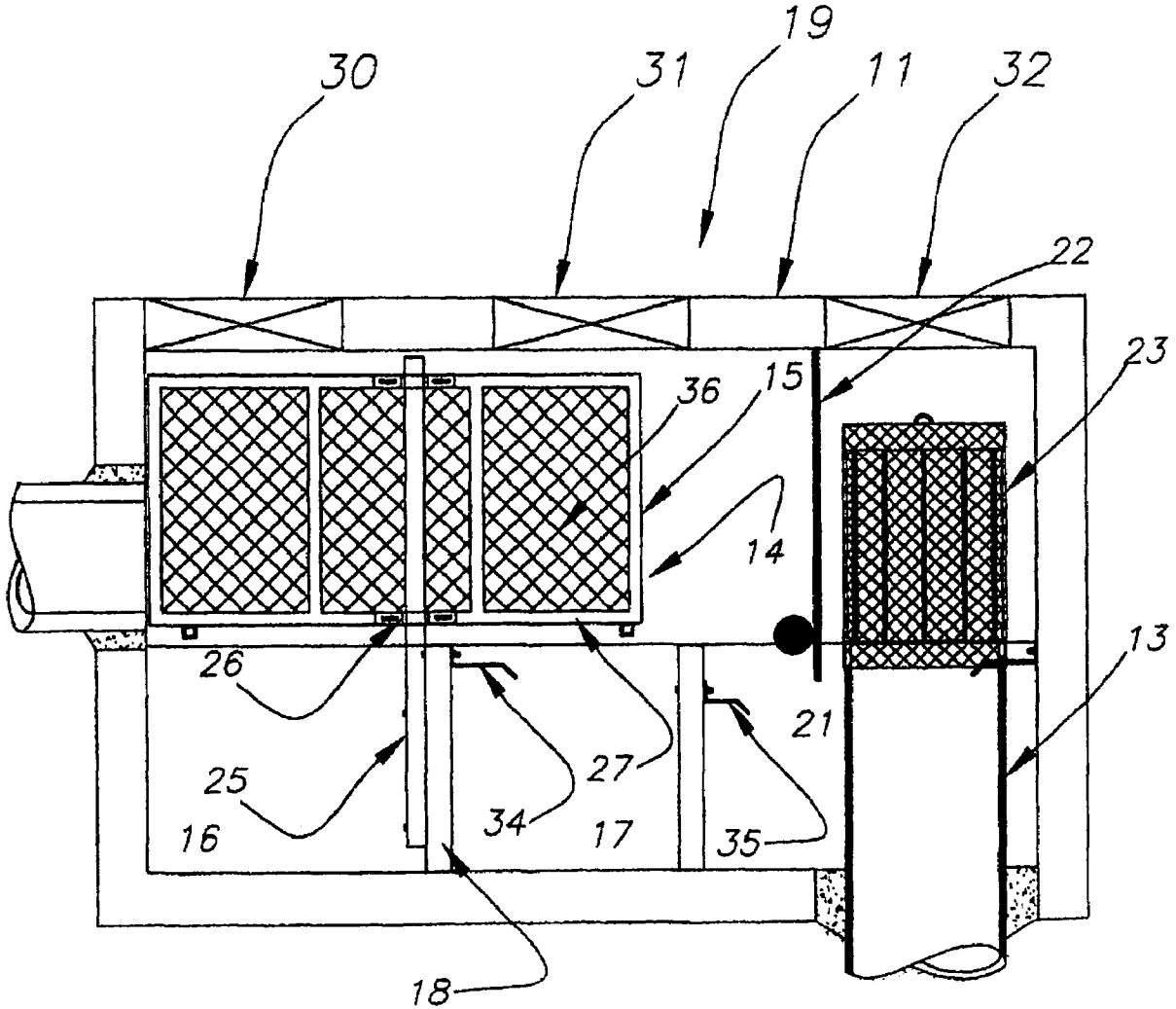
FIG. 2 is a sectional view of the baffle box of FIG. 1.
Figure 3:
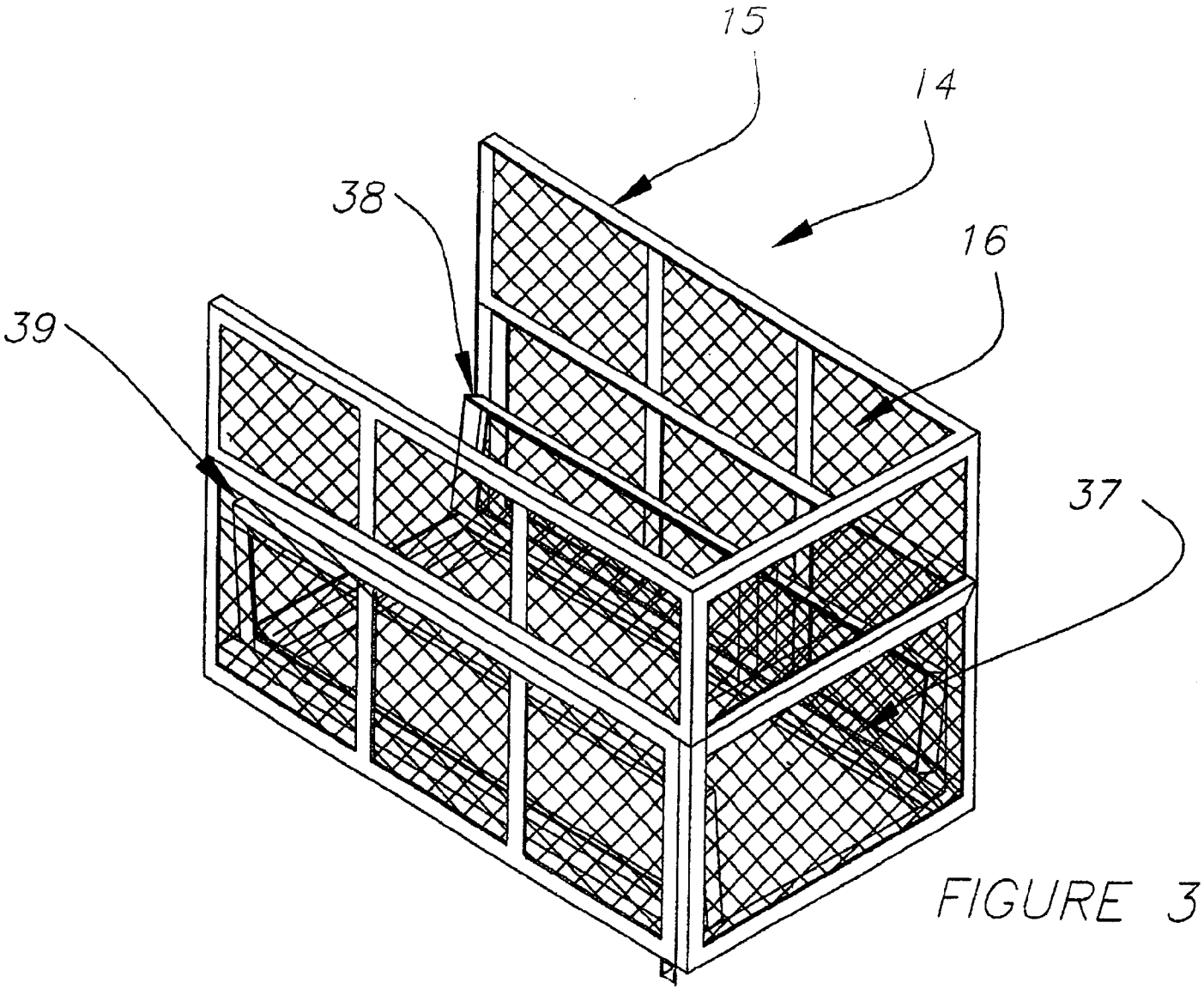
FIG. 3 is a perspective view of the inlet screen filter of FIGS. 1 and 2.

Referring to the drawings, FIGS. 1-3, a storm water drain filter system 10 includes a concrete housing or box 11 having an inlet pipe 12 for receiving drain water from streets, sidewalks, parking lots and the like. The housing 11 has an outlet 13 for discharging storm drain water received in the housing and discharging it into a well in the ground. The water received at the inlet 12 may contain debris, such as leaves, small limbs, and other organic materials, which are fed directly into a screen filter basket 14. The screen filter basket 14 may include fairly large wire screen supported on a basket framework 15. The screen filter 14 collects the organic materials, such as leaves, grass clippings and debris, while allowing the water to continue to pass through all sides of the filter basket. Sand and grit and heavy small particles pass through the bottom screen and into sediment basins 16 and 17 separated by a baffle wall 18 and by a baffle wall 20. The water collecting in the basin 16 collects the non-organic sediment and the water flows over the baffle wall 18 and into the collection basin 17 where other sediment, such as sand, is collected. Water then flows from the basin 17 over the baffle wall 20 and into the collection basin 21 after passing by the skimmer wall 22.

Organic debris is collected in the filter basket 14 while heavier sediment, such as sand and grit, are collected in the basins 16 and 17. The water is then directed through a screen filter 23 and into the outlet 13 where it is directed into the ground or may be directed back into a storm drain pipe. The organic debris collected in the basket 14 is held above the water level so that the organic materials collected can dry out without decaying in the water and releasing soluable nutrients into the water. Any debris or materials that escape the collection basket 14 are blocked from entering the outlet 13 and entering the discharge well by the screen filter 23 which has an open top 24 in case the screen filter 23 becomes stopped up or, it may have a removable top.

The filter basket 14 can have its framework 15 attached to metal posts 25 with clamps 26 which can be bolted to the framework 27 of the frame 15 clamping onto posts 25. The basket 14 can also sit on the top ledge 28 of the baffle wall 18 if desired.

The debris that collects in the basket 14 can be readily cleaned out with a vacuum hose by removing the man-hole cover 30 and inserting the vacuum hose from a vacuum truck directly through the opening and into the basket 14 to remove all of the leaves, grass and debris therefrom. Similarly, the man-hole covers 31 and 32 can be removed for cleaning the basket 14 and the screen filter 23. The baffle wall 18 has a turbulence deflector 34 attached thereto to block the continuing rolling turbulence from the rapid in-flow of water into the basin 17. A similar turbulence deflector 35 is attached to the baffle wall. 20 for blocking the continuous turbulence in basin 21 and thereby prevents the sand and collected sediment from being pushed from one basin to the next.

The bottom of the basket 14 includes the side screen walls 36 and the end screen wall 37 attached to the frame 15, and has a pair of bottom doors 38 and 39 hinged to the framework so that they can swing open, as shown in FIGS. 1 and 3. Swinging doors on the bottom of the basket 14 allow the bottom to be opened once the basket has been cleaned of debris to allow the vacuum hose from a vacuum truck to be inserted through the bottom of the basket 14 and into the sediment basins 16 and 17 for removing accumulated sediment, such as sand and grit. Thus, the filter system can be cleaned by simply removing the man-hole covers 30, 31, and 32, inserting a vacuum hose from a vacuum truck, and sucking out the accumulated debris from the filter basket 14, then opening the bottom of the filter basket doors 38 and 39 and removing accumulated sediment therebelow with the vacuum hose.

The water exiting the outlet 13 is shown flowing directly beneath the nutrient box 11 into the earth below where it can flow directly into a recharge well or, in places near the ocean or a water source, the water can be directed into a shallow well into a highly porous mass of earth where it can be discharged through the earth into the ocean or other water source. In areas where coral reefs are located, this has the advantage of helping protect the coral reefs from water with large amounts of soluable nutrients therein, such as might come from rotting organic debris.

It should be clear at this time that a storm drain filter system having a nutrient separating baffle box has been provided which advantageously removes organic debris from storm drain water in a manner to prevent the debris from rotting and which can be easily cleaned of debris and of sedimentary materials. It should also be clear that the present invention is not to be considered limited to the forms shown which are to be considered illustrative rather than restrictive.

We claim:

1. A storm water filter system comprising:

a housing chamber formed with at least one side wall and a bottom and having an inlet and an outlet, said outlet being connected to an in-ground well;

a plurality of interior walls located in said housing chamber between said inlet and outlet and attached to said housing bottom to form a plurality of sediment basins adjacent said housing bottom;

an inlet filter box having an open end located in said housing chamber and positioned with said open end facing said inlet;

an outlet screen filter positioned over said outlet for capturing debris from water entering said outlet and said outlet screen filter having a bypass for water to pass when said filter becomes partially blocked, said outlet screen filter extending generally vertical from said outlet and having an open top to allow water to bypass the filter screen when the filter screen is partially clogged; whereby a storm water filter system filters debris from storm water being fed thereinto and a screen filter further blocks debris from entering into an in-ground well.

2. A storm water filter system in accordance with claim 1 in which said outlet extends through said housing bottom into said chamber to about the height of said second interior wall and said outlet screen filter extends there above.

3. A storm water filter system in accordance with claim 2 in which one said interior wall has a turbulence deflector attached thereto to calm turbulence in the water in one said open sediment basin.

4. A storm water filter system in accordance with claim 3 in which a second said interior wall has a turbulence deflector attached thereto to calm turbulence in the water in a second open sediment basin.

5. A storm water filter system in accordance with claim 4 in which said inlet filter box has an opening bottom to allow access to clean each said open sediment basin formed in said housing chamber.

6. A storm water filter system in accordance with claim 5 in which said inlet filter box is adjustably supported on a pair of metal posts.

7. A storm water filter system in accordance with claim 6 in which said inlet filter box sits upon one said interior wall.

* * * * *